United States Patent [19]

Epner et al.

[11] 4,276,147

[45] Jun. 30, 1981

[54] APPARATUS FOR RECOVERY OF METALS FROM SOLUTION

[76] Inventors: Randolph L. Epner, 118 E. 92 St., New York, N.Y. 10028; Ahmad Sam, 671 Forest Ave., Paramus, N.J. 07652

[21] Appl. No.: 67,303

[22] Filed: Aug. 17, 1979

[51] Int. Cl.[3] ..... C25B 7/00

[52] U.S. Cl. ..... 204/272; 204/275

[58] Field of Search ..... 204/201, 275, 109, 149, 204/130, 105 R, 269, 272, 273, 64, 47, 37, 153, 186, 290 R, 280, 282

[56] References Cited

U.S. PATENT DOCUMENTS

| | | | |
|---|---|---|---|
| 820,113 | 5/1906 | Hinkson | 204/272 |
| 2,901,410 | 8/1959 | Dean et al. | 204/64 |
| 3,003,942 | 10/1961 | Cedrone | 204/272 |
| 3,161,919 | 12/1964 | Renaud | 18/47 |
| 3,282,808 | 11/1966 | Kandler | 204/37 |
| 3,457,152 | 7/1969 | Maloney, Jr. et al. | 204/130 |
| 3,459,646 | 8/1969 | Carlson | 204/153 |
| 3,694,341 | 9/1972 | Luck, Jr. | 204/273 |
| 3,706,646 | 12/1972 | Gibson, Jr. et al. | 204/149 |
| 3,718,552 | 2/1973 | Mortell | 204/271 X |
| 3,767,558 | 10/1973 | Rowe | 204/269 |
| 3,859,195 | 1/1975 | Williams | 204/272 |
| 3,899,404 | 8/1975 | Iverson | 204/130 |
| 3,980,541 | 9/1976 | Aine | 204/186 |
| 4,000,056 | 12/1976 | Kelleher | 204/272 |
| 4,026,784 | 5/1977 | Rivers | 204/273 |
| 4,093,532 | 6/1978 | Branibar | 204/271 |
| 4,105,531 | 8/1978 | Kuo et al. | 204/290 R |

*Primary Examiner*—R. L. Andrews

*Attorney, Agent, or Firm*—Amster, Rothstein & Engelberg

[57] ABSTRACT

A recovery cell placed directly into the tank holding the metal containing solution is used to recover the metal from solution. A cathode for use in recovery cells is formed of a cellular nonconductive base layer having an outer layer of conductive material.

14 Claims, 5 Drawing Figures

APPARATUS FOR RECOVERY OF METALS FROM SOLUTION

DESCRIPTION OF THE INVENTION

The invention relates to a method and apparatus for recovering metals from solution. The invention also relates to a new and improved cathode and to the method for forming the cathode for use in the method and apparatus for recovery of metals from solution.

There are many applications where it is necessary or desirable to recover a metal from solution. For example, in the manufacture of jewelry, precious metals such as gold or silver are plated onto a base metal. Some of the precious metal accumulates in a rinse solution known as the drag-out rinse during the plating process and would be lost if not recovered from the drag-out rinse. Environmental considerations require the removal of metal pollutants such as mercury, cadmium and silver, from solution to prevent the discharge of metal pollutants into sewers and sewage treatment facilities. Photographic processes require the recovery of silver which accumulates in solution during the photographic development process. It is apparent that the simple, efficient and economic recovery of a variety of metals from solution would be highly desirable and beneficial.

There have been many efforts, extending over a long period of time, to provide such a simple, efficient and economic system for recovery and metals from solution. These efforts have generally been directed to methods and apparatus for electroplating the metal dissolved in the solution onto a cathode in an electrolytic recovery cell. Such electrolytic recovery cells generally comprise a cathode and anode mounted in spaced apart relationship within a housing and connected to a source of DC current. The housing is positioned in a recovery tank. The solution containing the metal is pumped to the recovery tank and through the recovery cell and the metal plated out on the cathode. Periodically, the cathode is removed from the cell and processed to recover the metal.

One of the major drawbacks in the use of these prior art metal recovery systems, particularly in the recovery of gold from solution, has been the requirement that a separate recovery tank be provided within which the metal recovery process is carried out. In particular, in the recovery of gold from the drag-out rinse, it has heretofore been necessary to provide apparatus to circulate the drag-out rinse from the drag-out rinse tank to the recovery tank and return the drag-out rinse to the drag-out rinse tank. This prior art system has proved difficult to use for a number of reasons. First, space is always scarce, making it difficult to find a cite for the recovery tank and associated circulating system. Second, the circulating system can leak, causing flooding of the shop and total loss of the gold and solution. Third, explosion can occur due to the generation and accumulation of hydrogen and oxygen in the confined space of the recovery tank. Fourth, fungus and foaming can result from aeration of the solution as it circulates through the system.

Another major drawback of these prior art systems has been the construction of the cathode used in the recovery cell. It is known that the rate of deposition of a metal onto a cathode during electroplating is directly dependent upon the surface area of the cathode as well as the current density. Electroplating the metal onto the cathode in the recovery cell must be accomplished as quickly as possible particularly in systems wherein metal is constantly being added to the solution. To obtain satisfactory rates of electrodeposition of the metal onto the cathode, relatively large cathodes have been employed in order to achieve high surface area and satisfactory current density. Increasing the surface area, however, necessitated the use of larger recovery cells.

Cathodes which have been employed in cells for recovery of gold from solution, for example, have generally been formed of a metallic base layer such as expanded titanium or tantalum wire mesh plated with nickel. A typical example is disclosed in U.S. Pat. No. 4,097,347. To increase the total surface area of the cathode, multiple cathodes have been used, such as disclosed, for example, in U.S. Pat. No. 4,034,422. U.S. Pat. No. 3,331,763 discloses a recovery cell for recovering copper from solution which uses a cathode formed from a plastic sheet laminated between two copper sheets. U.S. Pat. No. 3,141,837 discloses a cathode formed of a substrate of glass or plastic sheet having a metalized surface used for electrodeposition of nickel-iron alloys. U.S. Pat. No. 3,650,925 discloses the use of a cathode formed of an electrically-conductive carbonacious material such as graphite or carbon used for recovery of various metals from solution.

It is an object of the invention to provide a new method and apparatus for recovering metals from solution and to provide a cathode and method for forming the cathode for use in such method and apparatus which overcomes the many disadvantages of the prior art.

It is a specific object of the invention to provide a compact and efficient system for recovery of metal from solution in which the recovery cell used in the system is placed directly into the metal containing solution.

It is a further object of the invention to provide a cathode for use in a method and apparatus for recovery of metals from solution which is formed of a material having a large surface area per unit volume thereby permitting the size of the cathode to be reduced without reducing the efficiency with which metal is recovered from the solution.

It is a more specific object of the invention to form the cathode formed from a cellular nonconductive base layer having an outer layer of conductive material of sufficient thickness to render it operative for use in the recovery of metal from solution. A particular object of the invention is to provide a cathode in which the nonconductive base layer is a plastic foam.

It is another object of the invention to provide a new and improved method for forming such cathodes. A still more specific object of this invention is to form a conductive layer onto a base layer of nonconductive material by electroless plating. Still further it is an object of this invention to prepare the base layer for electroless plating without the use of precious metals. It is also an object of the invention to provide a new and improved method of electroless plating of copper onto a surface.

In accordance with one aspect of the invention, a compact recovery cell is provided for use in a system for recovery of metals from solution which recovery cell can be placed directly into the metal containing solution. In one embodiment of the invention, the recovery cell includes a cylindrical housing, which may be made of a hard plastic such as polyvinylchloride. The inlet end of the housing has a single axial opening to receive the metal containing solution through an inlet pipe which is coupled to the outlet of a fluid pump. The outlet end of the housing has a plurality of holes therein which permit the solution to circulate out of the recovery unit. Mounted inside the housing, and concentric therewith is a cylindrical anode and a concentrically mounted cylindrical cathode. The cathode has a larger diameter than the anode and preferably, the outside diameter of the cathode is approximately equal to the inside diameter of the housing so that the walls of the housing provide additional structural support for the cathode. Provision is made for connecting an appropriate DC potential between the anode and cathode. In operation, the inlet to the recovery cell is connected to the outlet of a fluid pump, the anode and cathode are connected to an appropriate DC voltage source and the recovery cell is positioned at the bottom of the tank containing the solution. The pump circulates the metal containing solution into the inlet end of the recovery cell, between the anode and cathode, and out through the holes in the outlet end of the recovery cell. Metal from the solution is plated out onto the cathode. At regular intervals, the recovery cell is removed from the solution containing tank, the cathode removed from the recovery cell and the metal recovered from the cathode. In the recovery of gold from solution, the latter step is accomplished by placing the cathode in a solution of aqua regia as is well known in the art.

In accordance with another specific aspect of the present invention, a cathode for use in the recovery of metal from solution is formed of a nonconductive base layer having a conductive layer of sufficient thickness to render the cathode useful in the electrolytic recovery of metal from solution. Preferably, the base layer is an open-cell plastic foam such as urethane having about 95% porosity, plated with an intermediate layer of copper to render the base layer conductive and an outer layer of nickel to impart rigidity to the cathode structure and render it resistant to attack from chemicals which will be present in the solutions in which it will be used. The cathode thus formed has a large surface area, high degree of porosity, good conductivity and light weight, all of which properties are essential to providing the optimum cathode for use in the metal recovery system.

In accordance with still another specific feature of this invention, the cathode is formed by preparing the surface of the open cell foam base layer to receive the outer conductive layers and thereafter the conductive layers are deposited on the prepared surface. The surface of the foam base layer is prepared by first cleaning the surface to rid it of grease, dirt and other contaminates, etching it to create microscopic pores which serve as sites for the deposit of metal, and finally activating it to receive the conductive metal. Heretofore, activation of a base layer required the use of a precious metal, such as palladium, platinum or gold. It is one significant feature of the present invention that the use of a precious metal for activation is not required, thereby significantly reducing the cost of forming the cathode. After the base layer has been activated, a layer of copper is plated onto it by electroless plating. Finally, a layer of nickel is electroplated onto the copper layer.

These and other objects and features of the invention will become more apparent by referring to the drawings, in which.

Figure 2:
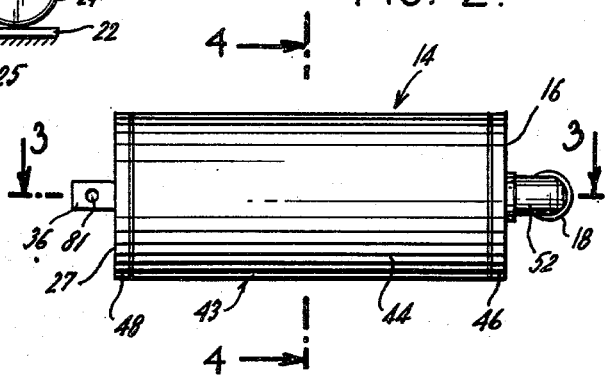
FIG. 2 is a front elevational view of the recovery cell of FIG. 1.
Figure 4:
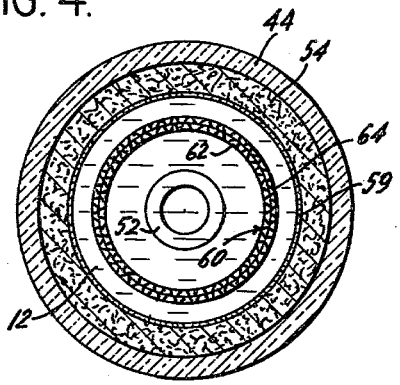
Figure 5:
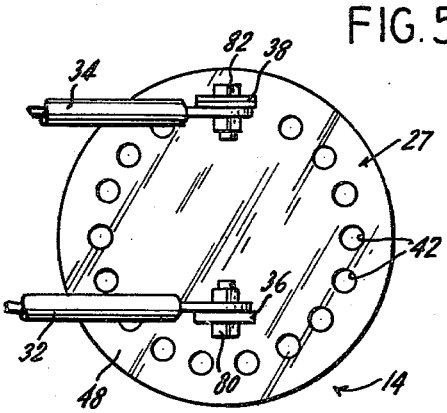

FIG. 4 is a sectional view taken along line 4—4 of FIG. 2 and looking in the direction of the arrows and showing the cross-sectional construction of the recovery cell; and FIG. 5 is an elevational view of the outlet end of the recovery cell showing the holes which permit solution to be circulated out of the recovery cell and showing the connection between the electrical cables and the anode and cathode.

Figure 1:
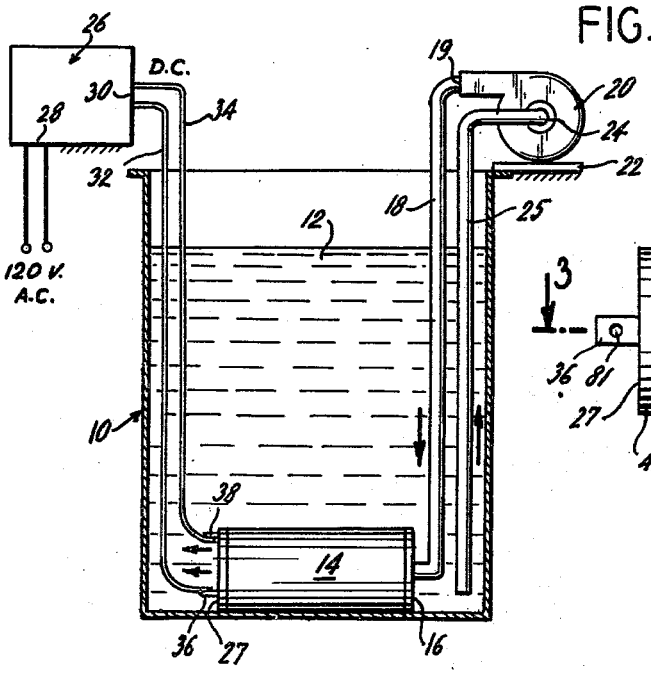
FIG. 1 is a longitudinal sectional view taken through the drag-out rinse tank used in a gold plating operation and showing a recovery cell positioned at the bottom of the drag-out rinse tank, a pump connected to the recovery cell for circulating the drag-out rinse through the recovery cell and a source of dc voltage coupled between the anode and cathode of the recovery cell.

Referring to FIG. 1, there is shown a representation of a typical drag-out rinse tank 10 used in a gold plating operation as part of a typical line for plating gold onto base metals. Drag-out rinse tank 10 contains drag-out rinse 12, which is a dilute solution of gold in water. Typically, the gold in solution is 900 parts per million. For many years, platers have used elaborate systems for recovery of gold from the drag-out rinse. These elaborate systems have included a recovery cell placed in a recovery tank which is separated from the drag-out rinse tank and an elaborate system of plumbing to circulate the solution to the recovery tank and back to the drag-out rinse tank. These prior art systems have been used despite the many known disadvantages, including: (1) difficulty in finding space for the recovery tank and circulating system; (2) leakage in the circulating system causing flooding and total loss of the gold; (3) creation of an explosive atmosphere due to generation of hydrogen and oxygen and (4) formation of fungus and foaming of the solution produced by aeration of the solution. Other difficulties with the prior art metal recovery systems in general, and gold recovery systems in particular, have involved the cathode material used in the recovery cell, and in particular providing a cathode material having a high surface area and low volume to permit efficient plating of metal onto the cathode. In accordance with one aspect of the invention, the disadvantages of the prior art recovery systems are obviated by placing the recovery cell directly into the metal containing the solution, for example, drag-out rinse tank 10. These recovery systems are further improved by forming the cathode from an open cellular nonconductive base layer of material, such as polyurethane foam, having a layer of conductive material to render the cathode operative for use in the recovery of metal from solution.

Figure 3:
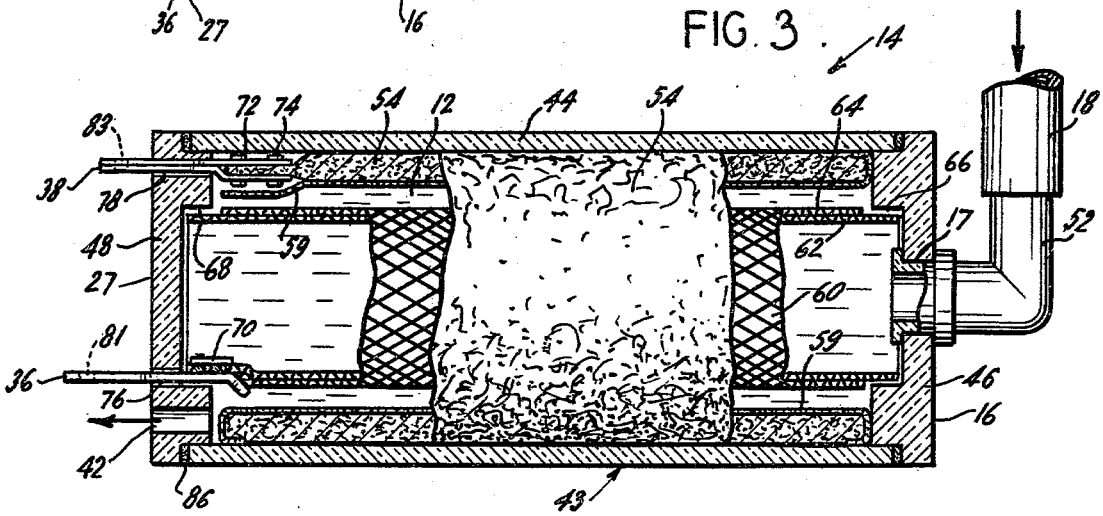
FIG. 3 is a sectional view taken along line 3—3 in FIG. 2 and looking in the direction of the arrows which is partially cut away to show the internal construction of the recovery cell.

Referring back to FIG. 1, the system for recovery of gold from drag-out rinse 12 includes recovery cell 14 positioned at the bottom of drag-out rinse tank 10. Recovery cell 14 includes an inlet end 16 having an axial opening 17 (FIG. 3) which receives hose 18 coupled to the outlet 19 of circulating pump 20 which is mounted in suitable support 22 immediately adjacent drag-out rinse tank 10. The inlet end 24 of pump 20 is coupled to hose 25 which opens to receive drag-out rinse 12. The outlet end 27 of recovery cell 14 has a plurality of holes 42 (FIG. 5) which permit drag-out rinse 12 to be circulated out of recovery cell 14 back into drag-out rinse tank 10. A source of DC current 26 has its input 28 coupled to a 120 v AC supply and is arranged to provide an adjustable dc potential at its output 30. The output 30 of dc voltage source 26 is electrically connected via electrical cables 32, 34, to ears 36, 38, which extend through holes in the outlet end 27 of recovery tank 14 and which are electrically connected to the anode and cathode respectively in the recovery cell as described in greater detail below.

In operation, pump 20 receives solution 12 through hose 25 typically at a rate of 5 gals/min. and pumps it into recovery cell 14 through opening 17 in end wall 16. A DC current of between 1.5 and 15 volts DC is applied between the anode and cathode of recovery cell 14 via cables 32, 34, connected to ears 36, 38. Typically, current of from 15–45 amps flows between anode and cathode as is well known in the art. As the drag-out rinse circulates through the recovery cell 14, gold is plated out onto the cathode. After passing through recovery cell 14 the solution flows through holes 42 (see FIG. 5) and back into drag-out rinse tank 10. Periodically, recovery cell 14 is removed from rinse tank 10 and the cathode removed from the recovery cell 14. The gold plated onto the cathode is recovered from the cathode by known methods which generally involve immersion of the cathode in aqua regia.

Referring now to FIGS. 2 through 5, there is shown additional details of the internal construction of recovery cell 14. As shown, recovery cell 14 has a cylindrical housing 43 having a cylindrical side wall 44 which is closed at its respective ends by inlet end wall 46 and outlet end wall 48. Inlet end wall 46 has axial opening 17 which receives the outlet end of elbow joint 52. The inlet end of elbow joint 52 is connected to hose 18 to receive drag-out rinse 12 from the outlet 19 of pump 20.

Mounted concentrically within housing 43 adjacent side wall 44 is cylindrical cathode 54. Cathode 54 is formed of any conductive material suitable for use in electroplating of metal from solution. Preferably, cathode 54 is formed from a cellular nonconductive base layer having a layer of conductive material of sufficient thickness to render it operative for use in recovery cell 14. The base layer may, for example, be an open cell polyester type polyurethane foam with coarse cell structure of approximately 20 to 40 cells per square inch which is plated with a layer of copper. The base layer and conductive layer may then be plated with an outer layer of metal, for example, nickel to impart rigidity to the cathode.

The cathode 54 is formed by first preparing the base layer to receive the outer conductive layers by cleaning, etching and activating the base layer. Then steps may be carried out as follows:

1. The polyurethane foam base layer, $11\frac{3}{8}'' \times 14'' \times \frac{1}{2}''$, is placed in a solution of 10% by weight of lead acetate in glacial acidic acid at room temperature for about one minute.

2. The polyurethane base layer is removed from the solution and excess solution removed from the polyurethane by washing.

3. The polyurethane base layer is placed in a solution of 50 grams per liter of potassium dicromate in a mixture of three parts water to one part 98% sulfuric acid for about one minute.

4. The polyurethane base layer is removed and washed.

5. Steps 1 through 4 are repeated.

6. The final step in the preparation of the polyurethane base layer is immersion in a solution of three grams per liter of potassium borohydride in water for about ten minutes.

The cellular polyurethane base layer is thus prepared for electroless copper plating in a copper-plating solution which consists essentially of the following compounds:

| Compound | Concentration | |
|---|---|---|
| EDTA disodium salt | 25 grams/liter | 3.32oz/gal |
| copper sulfate crystal | 25 grams/liter | 3.32oz/gal |
| Rochelle salt | 50 grams/liter | 6.64oz/gal |
| sodium hydroxide | 18 grams/liter | 2.40oz/gal |
| sodium carbonate | 7.5 grams/liter | 1 oz/gal |
| solution of 37% formaldehyde | 160 mililiters/liter | |

A volume of about $1\frac{1}{2}$ gallons of electroless plating solution is necessary for every square foot of the base layer. The electroless plating solution is formed by dissolving the EDTA disodium salt and copper sulfate crystal in hot water at a temperature of 110° to 140° by stirring. After these two compounds are completely dissolved, the Rochelle salt is added and completely dissolved, followed by the sodium hydroxide and then the sodium carbondate, making sure that each compound is fully dissolved before the next compound is added. The solution is then poured into a large shallow pan and maintained at a temperature of 110°–140° F. after which the solution of 37% formaldehyde is added. Immediately after the formaldehyde solution is added to the copper plating solution, the base layer is removed from the potassium borohydride solution, squeezed out and washed, laid horizontally in the electroless plating solution for about 20 to 30 minutes. Periodically, the base layer is turned to insure uniform plating. After about 25 minutes the base layer develops stiffness indicating that an adherent layer of copper, about 1/10,000 of an inch thick has been deposited on the base layer. The base layer is taken out of the solution and tested to determine whether it is conductive, such test being accomplished in accordance with methods well known in the art. When the base layer is removed from the electroless plating solution its surface is plated with copper, it is bright red and considerably more rigid than the original base layer.

Alternatively, the base layer can be made conductive by other metals such as, but not limited to, silver, nickel, lead, cadmium and alloys. It is next air dried at room temperature and prepared for electroplating with nickel. The copper plated cathode is placed around a plastic tube four inches outside diameter and sewn, staped or otherwise held together at the seam. This plastic tube is placed in a nickel-plating tank and nickel plated at a current of 50 amps for one hour. The cathode is removed from the nickel plating solution and the plastic cylinder inside the cathode is taken out. The unsupported cathode is returned to the nickel plating tank and plated with nickel at 50 amps for two more hours. The cathode 54 is then removed from the nickel plating tank, washed and dried in a dry atmosphere at room temperature. Finally a polypropylene anode bag 59 is placed over the cathode. The anode bag 59 permits the solution containing the gold ion to contact the cathode 54 but prevents gold metal from returning to the solution.

Mounted concentrically with cathode 54 is anode 60 which consists of an inner cylinder 62 of expanded titanium mesh surrounded by an outer cylinder 64 of titanium mesh plated with platinum and locked to the inner cylinder 64 by, for example, spot welding. Inner cylinder 62 is longer than outer cylinder 64 and the opposite ends of inner cylinder 62 are received within seats 66, 68 formed with end walls 46, 48 respectively of recovery cell 14 which support anode 60. In accordance with further details of the construction of recovery cell 14, titanium ear 36 is welded to titanium plate 70 to provide electrical connection to anode 60 at one end thereof. Titanium ear 38 is electrically connected to one end of cathode 54 by bolts 72, 74. Ears 36, 38 extend through openings 76, 78 in end wall 48 of recovery cell 14 to connect with electrical cables 32, 34. Electrical cable 32 is attached to ear 36 of anode 60 by use of a titanium bolt 80, which passes through hole 81 to electrically connect ear 36 to the uninsulated copper end of cable 32. The area of contact between the copper and titanium must be sealed by caulking compound to prevent the copper cable from dissolving, which will occur when copper is in an anionic solution such as drag-out rinse 12. For connection to cathode 54, a copper ring is formed at the end of cable 34 and bolted to ear 38 by titanium bolt 82 through hole 83 in ear 38. The end of the cable is insulated (not shown) to prevent gold from depositing on ear 38 or the end of cable 34. Finally, inlet end wall 46 and outlet end wall 48 as sealed to side walls 44 of recovery cell 14 by a ring of hot melt glue, as indicated by reference numeral 86.

Although the preferred form of the invention has been shown and described, many features may be varied, as will readily be apparent to those skilled in this art. Thus, the recovery cell can be used to recover other metals from solution such as silver, cadmium, and mercury, as will be apparent to those skilled in the art.

Many types of nonconductive cellular base layers can be used to form the cathode as well as a variety of conductive layers. Furthermore, only a single conductive layer is necessary to render the cathode operative. The method used for forming the cathode can also be varied without impairing the resulting cathode. The recovery call can be used directly in the tank holding the metal containing solution or in a separate recovery tank. Thus, the foregoing description is illustrative and not limiting, the invention being defined by the following claims.

What is claimed is:

1. Apparatus for electrolytic recovery of metal from a solution contained in a tank adapted to be placed directly in said tank comprising a housing including an inlet and outlet to permit circulation of the solution containing the metal to be recovered therethrough, an anode positioned within said housing, a cathode positioned within said housing in spaced apart relationship with said anode to permit the solution to flow between said anode and cathode, said cathode including a base layer of cellular nonconductive material having a conductive layer thereon of sufficient thickness to render said cathode operative, said anode and cathode being adapted to be coupled to a source of DC current, whereby solution may be circulated through said housing and metal from said solution deposited in said cathode from which it may be recovered.

2. The apparatus of claim 1 wherein the metal in solution is gold.

3. The apparatus of claim 2 wherein said cellular nonconductive material is a plastic foam and said conductive layer includes copper.

4. The apparatus of claim 3 wherein said copper layer is formed on said base layer by electroless plating.

5. Apparatus of electrolytic recovery of metals from a solution contained in a tank comprising a housing including an inlet and an outlet, said inlet being adapted to receive solution containing said metal and to permit said solution to enter said housing, said outlet adapted to permit said solution to flow out of said housing, an anode positioned within said housing, a cathode positioned within said housing in spaced apart relationship with said anode to permit the solution to flow between said anode and cathode, said cathode comprising a base layer of cellular nonconductive material having a conductive layer thereon of sufficient thickness to render said cathode operative, said anode and cathode being adapted to be coupled to a source of DC current whereby solution may be circulated through said housing and metal from said solution deposited on said cathode from which it may be recovered.

6. The apparatus of claim 5 wherein said housing is constructed and arranged to be positioned within the solution containing tank.

7. Apparatus for recovery of gold from the drag-out rinse contained within the drag-out rinse tank on a gold plating line comprising a housing adapted to be placed into the drag-out rinse tank including an inlet and an outlet, said inlet being adapted to receive the drag-out rinse and to permit said drag-out rinse to enter said housing, said outlet adapted to permit said drag-out rinse to flow out of said housing, an anode positioned within said housing, a cathode positioned within said housing in spaced apart relationship with said anode to permit said drag-out rinse to flow between said anode and cathode, said cathode including a base layer of cellular nonconductive material having a conductive layer thereon, said anode and cathode being adapted to be coupled to a source of DC voltage whereby said drag-out rinse may be circulated through said housing and gold deposited on said cathode from which it may be recovered.

8. The apparatus of claim 7 wherein said cellular nonconductive material is a plastic foam and said conductive layer includes copper.

9. Apparatus for recovery of gold from a solution contained within a tank comprising a housing adapted to be placed into the tank including an inlet and an outlet, said inlet being adapted to receive the solution and permit said solution to enter said housing, said outlet being adapted to permit said solution to flow out of said housing, an anode positioned within said housing, a cathode positioned within said housing in spaced apart relationship with said anode to permit said solution to flow between said anode and cathode, said cathode including a base layer of cellular nonconductive material having a conductive layer thereon, said anode and cathode being adapted to be coupled to a source of dc voltage whereby said solution may be circulated through said housing and gold from said solution be deposited on said cathode from which it may be recovered.

10. A system for recovery of gold from the drag-out rinse contained within the drag-out rinse tank on a gold plating line comprising a recovery cell positioned in the drag-out rinse tank including a housing having an inlet and an outlet to permit circulation of the drag-out rinse therethrough, an anode positioned in the housing, a cathode positioned in the housing in spaced apart relationship to permit the drag-out rinse to circulate between the anode and cathode, said cathode including a base layer of cellular nonconductive material having a conductive layer thereon, a pump having an outlet coupled to the inlet of said recovery cell and an inlet coupled to receive the drag-out rinse, a source of DC current coupled between the anode and cathode whereby said pump circulates drag-out rinse into the inlet of said recovery cell, through said recovery cell and out of the outlet thereof and gold from the drag-out rinse is plated onto the cathode from which it may be recovered.

11. Apparatus for electrolytic recovery of metal from a solution comprising a housing including an inlet and an outlet, said inlet being adapted to receive the solution and said outlet adapted to permit said solution to flow out of said housing, an anode positioned within said housing, a cathode positioned within said housing in spaced apart relationship with said anode to permit the solution to flow between said anode and cathode, said cathode including a base layer of nonconductive material having a conductive layer selected from a group consisting of at least one of copper, silver, nickel, lead, and cadmium formed thereon of sufficient thickness to render said cathode operative, said anode and cathode being adapted to be coupled to a source of DC current whereby when solution is circulated through said housing metal from said solution is deposited on said cathode from which it may be recovered.

12. The apparatus of claim 11 wherein said housing is constructed and arranged to be positioned in the solution.

13. Apparatus for electrolytic recovery of metal from a solution comprising a housing adapted to be positioned in the solution, said housing including an inlet and an outlet, said inlet being adapted to receive the solution, and said outlet adapted to permit said solution to flow out of said housing, an anode positioned within said housing, a cathode positioned within said housing in spaced apart relationship with said anode to permit the solution to flow between said anode and cathode, said cathode including a base layer of nonconductive material having a conductive layer formed thereon of sufficient thickness to render said cathode operative, said anode and cathode being adapted to be coupled to a source of DC current whereby when solution is circulated through said housing metal from said solution is deposited on said cathode from which it may be recovered.

14. A system for recovery of metal from solution contained within a tank comprising a recovery cell positioned in the tank including a housing having an inlet and an outlet to permit circulation of the solution in the tank therethrough, a generally cylindrically shaped anode within the housing having an axis extending in a pre-selected direction, a generally cylindrically shaped cathode having an axis and a diameter greater than the diameter of said anode and positioned within the housing surrounding said anode with the axis of said cathode substantially parallel to the axis of said anode, said anode and cathode arranged within said housing with respect to the inlet and outlet thereof to permit the solution to circulate between the anode and cathode in a direction generally parallel to the axes of the anode and cathode, a pump having an outlet coupled to the inlet of said recovery cell and an inlet coupled to receive the solution, a source of DC current coupled between the anode and cathode whereby as the solution is circulated through said recovery cell metal from the solution is deposited onto the cathode from which it may be recovered.

* * * * *